United States Patent [19]

Hayes

[11] Patent Number: 4,772,231

[45] Date of Patent: Sep. 20, 1988

[54] UNITARY MOLDED SEALED CONNECTOR WITH MODULAR KEYING AND TERMINAL RETENTION

[75] Inventor: Earl J. Hayes, Advance, N.C.

[73] Assignee: AMP Incorporated, Harrisburg, Pa.

[21] Appl. No.: 928,084

[22] Filed: Nov. 7, 1986

[51] Int. Cl.[4] ..... H01R 13/514

[52] U.S. Cl. ..... 439/752; 439/272; 439/283; 439/680

[58] Field of Search ..... 339/186 R, 186 M, 184 M, 339/184 R, 90, 206 P, 206 R, 207 R, 209, 94 M, 94 R, 210 M, 210 R, 211; 439/752, 732, 738, 750, 733, 737, 739, 869, 747, 283, 586, 587, 597, 598, 599, 603, 271, 272, 273, 274, 275

[56] References Cited

U.S. PATENT DOCUMENTS

| | | | |
|---|---|---|---|
| 2,881,406 | 4/1959 | Arson | 339/94 M |
| 3,518,617 | 6/1970 | Bosworth et al. | 339/206 P |
| 4,123,131 | 10/1978 | Pearce, Jr. et al. . | |
| 4,173,349 | 11/1979 | Neale, III . | |
| 4,186,987 | 2/1980 | Pearce, Jr. et al. . | |
| 4,225,206 | 9/1980 | Roman, Jr. . | |
| 4,241,971 | 12/1980 | Leonard, Jr. et al. . | |
| 4,274,702 | 6/1981 | Buck et al. | 339/94 M |
| 4,293,182 | 10/1981 | Schwartz . | |
| 4,311,355 | 1/1982 | Plyler et al. . | |
| 4,426,124 | 1/1984 | Vandevier | 339/94 M |
| 4,443,048 | 4/1984 | Moist, Jr. | 339/206 R |
| 4,557,542 | 12/1985 | Coller et al. . | |
| 4,580,863 | 4/1986 | Lohr et al. | 339/94 M |
| 4,588,242 | 5/1986 | McDowell et al. . | |
| 4,601,528 | 7/1986 | Spier . | |
| 4,639,061 | 1/1987 | Muzslay . | |
| 4,664,461 | 5/1987 | Schubert et al. . | |

FOREIGN PATENT DOCUMENTS

| | | |
|---|---|---|
| 968707 | 6/1961 | United Kingdom . |
| 2013047 | 1/1979 | United Kingdom . |
| 2068654 | 12/1980 | United Kingdom . |

OTHER PUBLICATIONS

U.S. patent application Ser. No. 862,902, filed May 13, 1986.

U.S. patent application Ser. No. 453,327, filed Dec. 27, 1982.

General Motors "Metri-Pack" Publication (6/83) pp. A-24 & A-97.

U.S. patent applicaton Ser. No. 854,719, filed Apr. 16, 1986.

U.S. patent application Ser. No. 882,751, filed Jul. 7, 1986.

U.S. patent application Ser. No. 696,286, filed Jan. 30, 1985.

*Primary Examiner*—Eugene F. Desmond

*Attorney, Agent, or Firm*—Robert W. Pitts

[57] ABSTRACT

A sealed electrical connector having a dual molded sealed construction with a rigid body portion and integral wire seals and an integral interfacial seal formed of a material more flexible than the rigid body. The mating connectors each receive a plurality of terminals at least partially within separate passages and one connector housing has a common cavity with which the passages communicate. A retention and keying insert received within the cavity both retains the terminals and provides modular keying to segregate otherwise identical connectors. A matable cap attached to the other member engages the retention insert. The insert and cap are formed from a material less susceptible to plastic flow than the rigid body and plastic flow of the rigid body captures the insert and the cap.

15 Claims, 8 Drawing Sheets

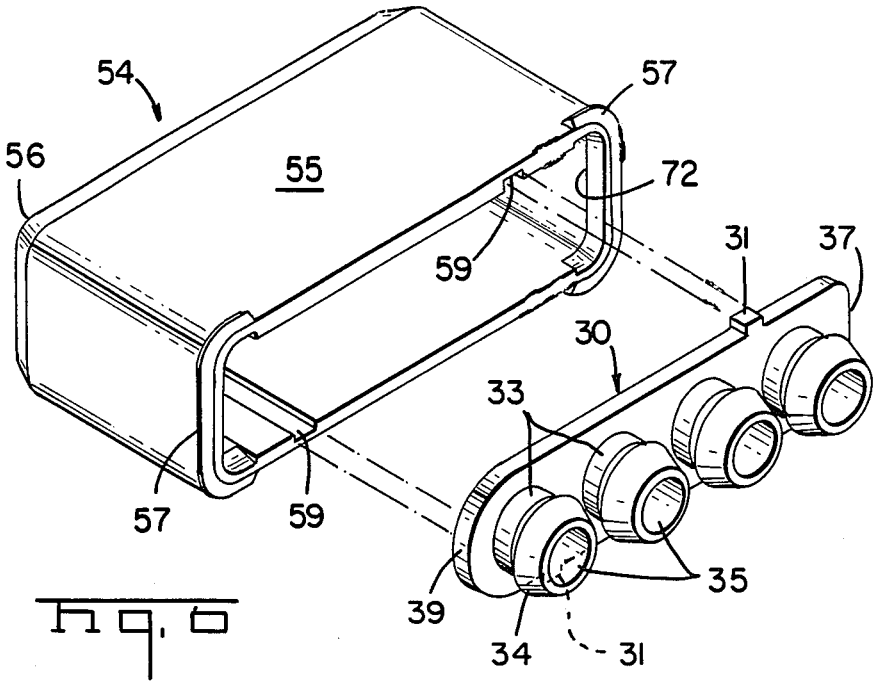
Fig. 6
Fig. 7
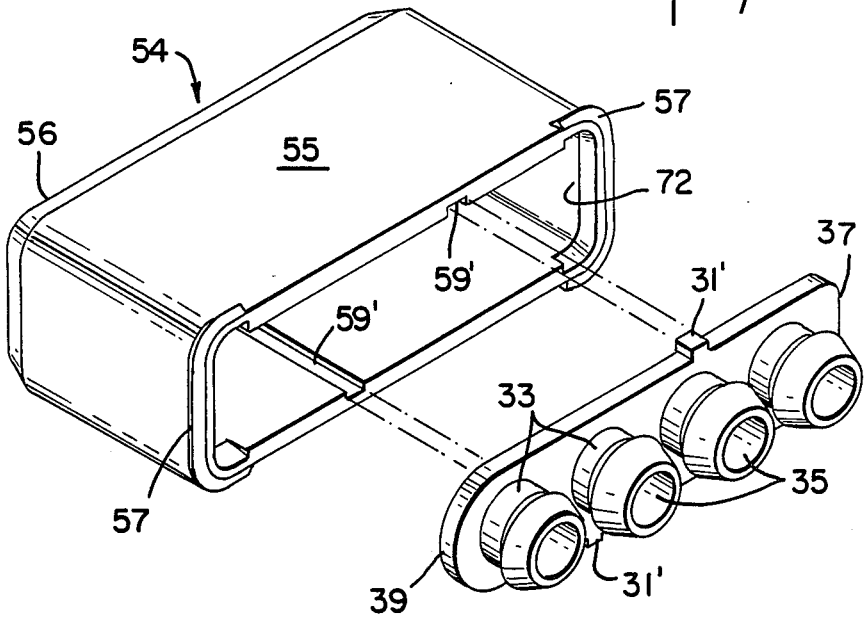

UNITARY MOLDED SEALED CONNECTOR WITH MODULAR KEYING AND TERMINAL RETENTION

BACKGROUND OF THE INVENTION

1. Field of the Invention

This invention relates to electrical connectors of the type used to form a sealed electrical interconnection and more specifically to electrical connectors having a unitary body consisting of a rigid portion and a deformable sealing portion formed by a dual molding process.

2. Description of the Prior Art

U.S. patent application Ser. No. 862,902 filed May 13, 1986, a Continuation-In-Part of U.S. patent application Ser. No. 453,327 filed Dec. 27, 1982, now abandoned, discloses an electrical connector employing a one-piece molded connector having a flexible sealing material chemically joined to a more rigid material of the type suitable for retaining and separating electrical contact terminals normally used in detachable electrical connectors. The one-piece housing depicted in these two patent applications is formed by a dual molding process in which one material is first injected into a mold, followed by the movement of core pins or sleeves to define one or more adjoining cavities into which the second material can be injected. The disclosure of each of these two pending patent applications is incorporated herein by reference.

Dual molded sealed connectors of the type discussed in that application can be employed in lieu of sealed electrical connectors which employ discrete sealing elements surrounding individual conductors or discrete seals located at the interface between male and female connectors. One example of such a connector employing discrete seals is that shown in U.S. Pat. No. 4,311,355. That connector employs discrete wire seals which are crimped to the insulation by the terminal. An interfacial seal surrounding a plurality of projecting cylindrical towers establishes a seal at the interface between male and female connectors. The assembly of this connector requires that the interfacial seal be assembled on the male connector and each wire seal be crimped to the wire before insertion of the terminals into the connector. Hinged secondary locks must then be closed to provide a secondary lock for the terminals. Numerous assembly operations, generally unsuitable for automated handling, are required when using this connector. Furthermore, this connector is unsuitable for modular keying since there is no provision for selective keying between male and female connectors. All male connectors are identical and all female connectors are identical.

U.S. Pat. No. 4,311,355 discloses a connector in which the terminal and seal are both attached to the wire before inserting the terminals into the rear portion of each housing. Resilient latches are used as retaining features. The connector in U.S. Pat. No. 4,588,242 is also a sealed connector. In this connector a wire is inserted from the rear of the connector housing and terminals are crimped onto the stripped wire on the front of the housing before pulling the crimped terminal back into the housing. Thus this connector does not require that the terminal be inserted through wire seals at the rear of the connector.

In addition to sealing, another requirement of conventional connectors is that some means be provided for retaining the terminals against pull out or push out durng their life. U.S. Pat. No. 4,557,542 discloses a connector having a retaining and sealing means inserted into the connector from the front of the connector after the terminals are in position, thus serving as a locking device.

The connector disclosed and claimed herein provides a simplified connector in which there is no requirement to insert seals in an assembly process and in which male and female connectors can be selectively keyed to ensure proper interconnection between the corresponding conductors. Furthermore, the connector described and claimed herein also is suitable for automated handling and assembly.

SUMMARY OF THE INVENTION

The dual molded sealed connector assembly comprising the preferred embodiment of this invention includes mating connector members each having a relatively rigid body portion and at least one more flexible sealing member. Although the more rigid body portion and the more flexible sealing members are formed of different materials, each connector half is formed in one dual molding operation in the same mold so that the more rigid body and the more flexible seal form a unitary member.

One of the connector halves has a plurality of passages extending partially through the rigid body with each passage communicating with a common cavity adjacent the mating end to the body. A wire seal having holes in alignment with the passages is integral with one end of the rigid body portion. The interior surface of the cavity is smooth and forms a sealing surface. A retention insert having sidewalls extending from a base can be inserted into the cavity. Terminals in this connector half extend through the passages and through holes in the base of the retention insert. The retention insert is formed of a material less susceptible to plastic flow than the rigid body and after insertion the body flows around ribs of the insert, with time, to capture the retention insert. The height of the insert sidewalls is less than the height of the cavity and the free ends of the sidewalls are spaced from the mating end of this connector half when fully inserted, thus leaving a portion of the sealing surface exposed.

The other connector half has passages extending throughout the entire length of the more rigid body and wire seals similar to those of the first connector half. An integral peripheral interfacial seal is spaced from the mating end of the second connector half and engages the sealing surface when the two connector halves are mated. A retention cap having tubular projections insertable into the passages engages this connector half in the same manner as the retention insert and prevents the terminals positioned in the passages from being pushed out of the mating end of this connector half. Corresponding keys and keyway slots on the retention insert and retention cap provide a modular keying system which permits discrimination between otherwise identical connector halves.

BRIEF DESCRIPTION OF THE DRAWINGS

FIG. 3 is a perspective view, partially in section, of a female connector showing the manner in which a terminal is seated in the connector housing and a keying and retention insert.

FIG. 5 is a sectional view of mated male and female connectors.

FIGS. 6, 7 and 8 are views of selectively keyed retention inserts and retention caps, illustrating the modular nature of this invention.

FIG. 9 is a view of an alternate unsealed version of this connector.

DETAILED DESCRIPTION OF THE PREFERRED EMBODIMENT

Figure 1:
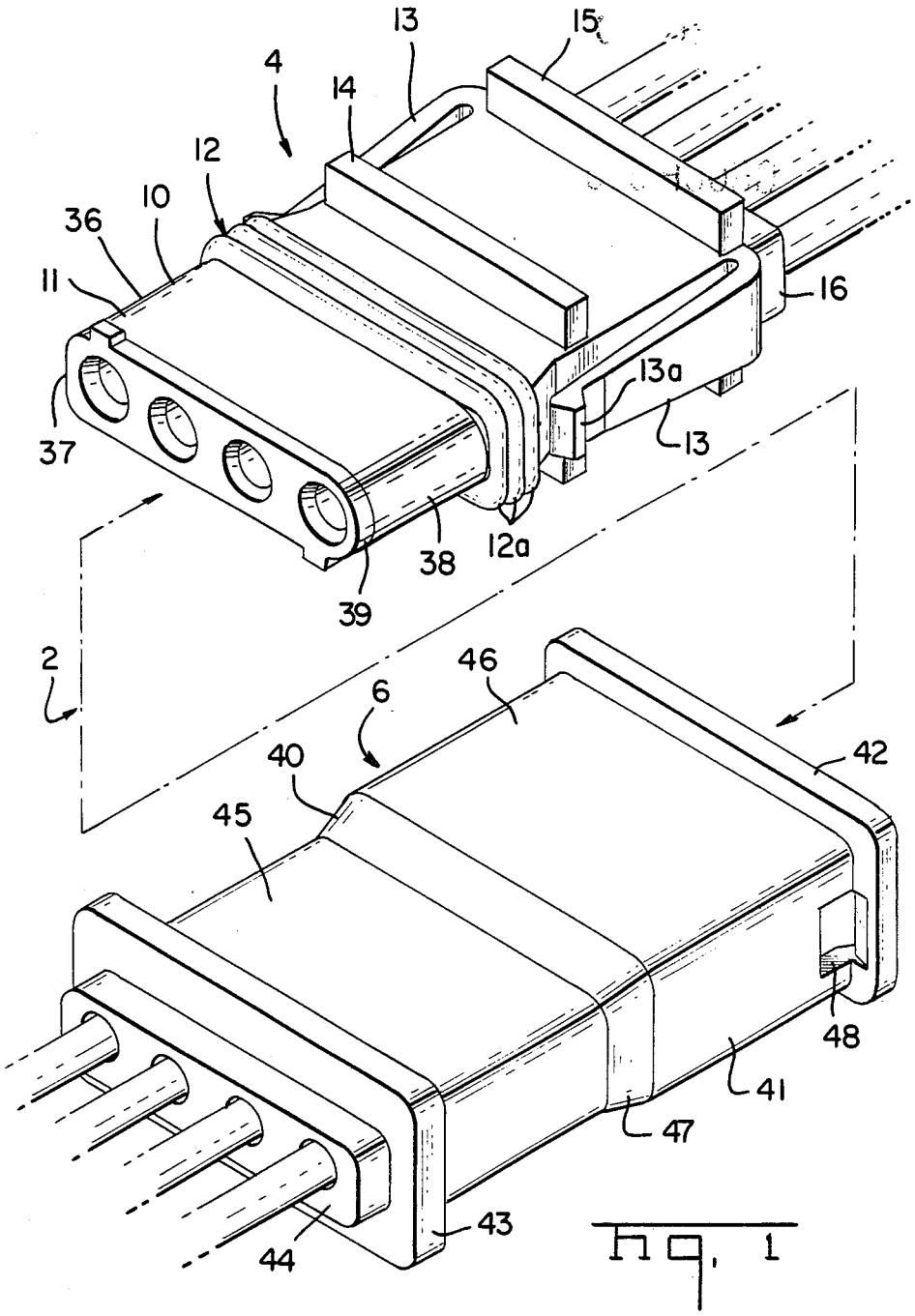
FIG. 1 is a perspective view of male and female electrical connector halves.

The electrical connector assembly 2 comprising the preferred embodiment of this invention consists of mating male and female connectors 4 and 6, respectively, each having a plurality of electrical contact terminals 20 and 60, respectively. The preferred embodiment of this invention is intended to interconnect a plurality of insulated wires C. It should be understood, however, that this invention is not limited to the interconnection of separate wires. For example, this invention could be directed to the interconnection of a plurality of wires to a corresponding plurality of pins located within a pin header, or for use with conductors in a flat cable.

The two connector halves 4 and 6 each consist of a housing 10, 40, respectively, with a plurality of terminals 20, 60. Each housing consists of a unitary or one-piece member consisting of a relatively more rigid insulating body portion 11, 41 and one or more relatively more flexible sealing members 12, 16, 44. The one-piece body members 11, 41 are formed by a molding process in which one portion of the housing is initially formed by injecting a first composition into a mold and a second material is subsequently injected after shiftable elements of the mold are repositioned to form an adjoining cavity. A typical mold cycle time would be from thirty to thirty-five seconds, during which a single component having both a rigid body and a flexible seal forming one integral element is formed. By injecting both materials into the same mold as part of the same operation, the flexible member adheres to the more rigid member to form a one-piece housing element. In the preferred embodiment of this invention the more rigid housing elements are formed from a material such as a polypropylene. One material suitable for use in forming the rigid housing body is Polyflam 1174 manufactured by A. Schulman Inc. A suitable material for forming the more flexible sealing elements is Santoprene. Santoprene is a trademark of Monsanto.

Figure 4:
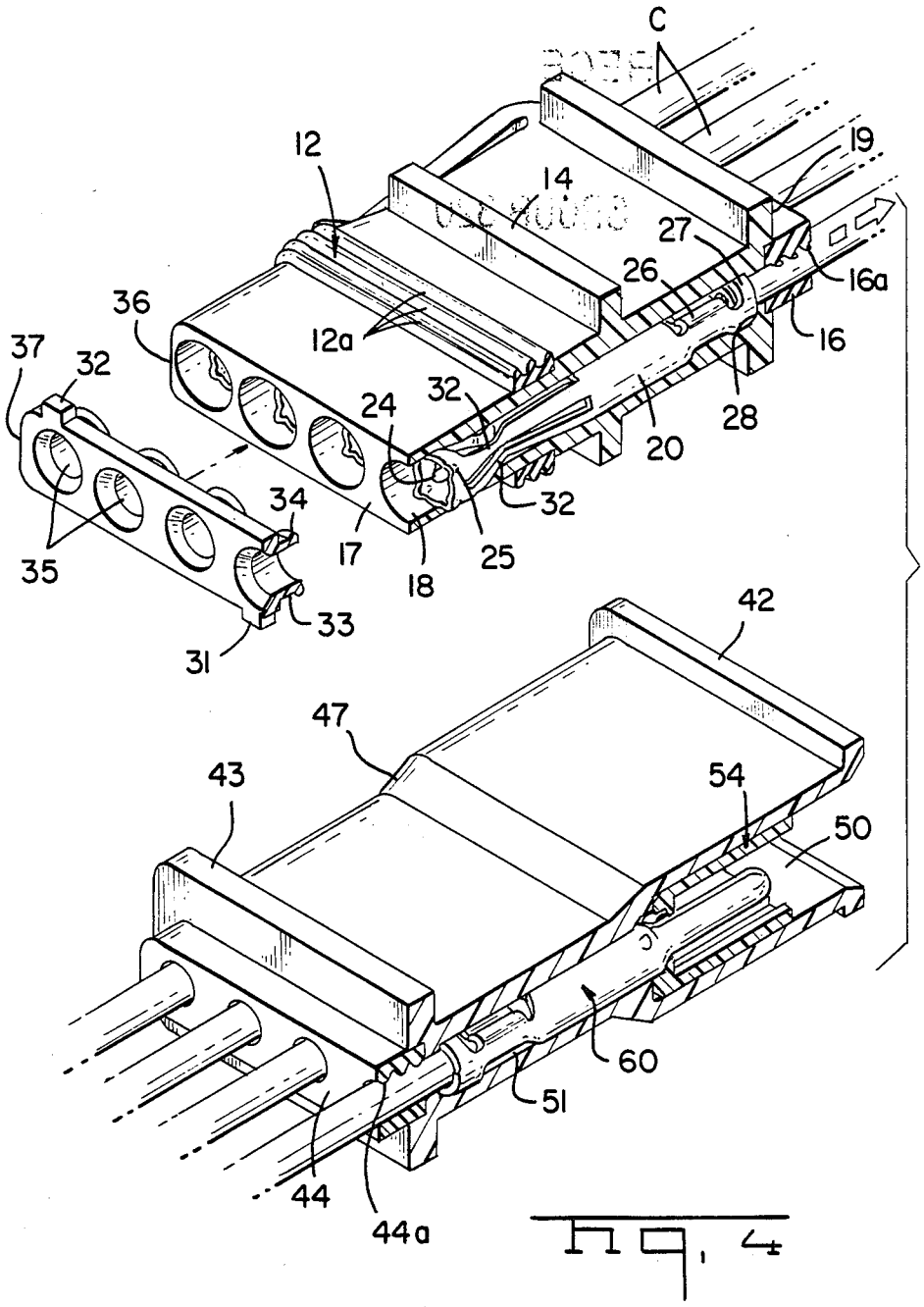
FIG. 4 is a perspective view, partially in section, of both male and female connectors.
Figure 7:
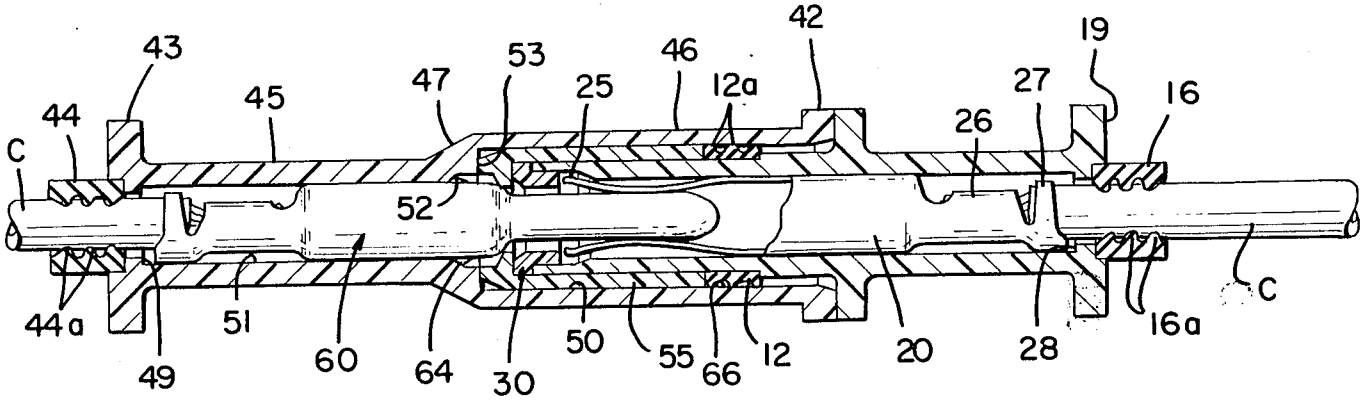

The receptacle housing 10 includes a relatively more rigid body portion 11 and sealing portions 12 and 16. The interfacial seal 12 is formed intermediate the ends of the body portion 11 and extends around the periphery or exterior of the more rigid body 11. The wire seal 16 is located along the rear face of the rigid body 11. The interfacial seal 12 has a plurality of protruding ribs **12*a*, each separated by an intermediate recess or valley. As shown in FIG. 4, each of the ribs 12*a* extend from a common base which is integrally formed with rigid body 11. The generally prismatic body 11 has a plurality of passages 18 extending between a front face 17 and a rear face 19. The unitary wire seal member 16, which similarly is integral with the body 11, is formed along the rear face 19. Seal 16 has a plurality of sealing ribs 16*a* extending inwardly to constrict the passage through seal 16. Seal 16 has a plurality of holes extending therethrough in alignment with respective passages 18. These holes in seal 16 are similar to the holes in seal 44 in the mating connector half 40**.

The relatively rigid body portion 11 has a plurality of latching arms 13, each having a latching boss **13*a* at its forward end. These arms are integral with the housing body 11 at the rear of the housing adjacent to the seal 16. Two flanges 14 and 15 extend outwardly from the top and bottom of the rigid body 11 as shown in FIG. 1. Flange 14 extends along the intermediate portion of the body 11 while flange 15 is located at the rear of the rigid body. These flanges 14 and 15 stabilize the connector housing 10 by ensuring that the housing can be properly oriented parallel to a level surface. Thus the connector can be positioned in a prescribed manner for automatic handling and assembly purposes. The front portion of the rigid body 11 has one flat edge 36 and one rounded edge 38**, which serves to provide an asymmetric orientation for the connector, thus providing a unique orientation for the respective terminals in the housing.

A terminal retention cap 30, having a plurality of openings 35 and a plurality of cylindrical or tubular protruding ribs 34 along the rearward face, is matable with the rigid body 11 at its front face. Each cylindrical projection has a protruding rib 34 at its rearward end. These protruding ribs 34 form an interference fit within the passages 18 when the cap is positioned at the front of housing 11. In the preferred embodiment of this invention, the retaining cap 30 is formed of a material less susceptible to plastic deformation than the relatively rigid body 11. For instance, this cap 30 can be formed of a polyester material, preferably a filled polyester. One polyester suitable for use in this application is 420 SEO Valox. Valox is a trademark of General Electric Co. After the cap 30 is positioned on the front face 17 of body 11, the material forming the body 11, which is more susceptible to plastic flow than the material forming the retention cap will with time form around the rib 34 to even more securely hold the retention cap in place. When the materials described herein are employed, the material forming the body 11 will plastically deform within 24 hours and under normal conditions for a tight fit to the ribs 34.

The receptacle terminals 20 employed in the preferred embodiment of this invention are generally conventional stamped and formed terminals having leaf springs 32 forming a constricted contact portion adjacent the forward edge. A plurality of contact retention bosses 25 are located at the forward edge of terminals 20. These contact retention bosses extend radially beyond the remaining periphery of the terminals 20 and abut the tubular projection 34 of retention cap 30 when the tubular retention cap is inserted within the terminal receiving passages 18. Bosses 25 are also engageable with a beveled surface within passages 18 preventing withdrawal of the terminals 20 beyond their desired location in the housing. The receptacle terminals 20 have a conventional crimp 26 for engaging the conductive core of the conductor C and an outer insulation strain relief crimp 27.

In the preferred embodiment of this invention, conductors C are first inserted through the opening in seal 16 with the forward end of the conductors being inserted beyond the forward face 17 of the housing 10. If not previously stripped, the conductors can then be stripped of the outer insulation adjacent the end. Then the terminals 20 can be attached to the ends of the conductors by conventional means such as crimping. As shown in FIG. 4, the conductors, with terminals attached, can then be reinserted from the forward mating face into the passages 18. The rear portion of the terminals engage a restricted retaining shoulder 28 at the rear passages 18 adjacent seal 16 to prevent the terminal from being extracted from the rear of the connector. Note the retaining shoulder 28 projects the seal 16. It is unnecessary to insert the terminal through seal 16. The retainer cap 30 can then be inserted to fully capture the terminals 20 within the passages 18.

The mating pin housing 40 of this connector is formed of a pin housing body 41 which is relatively more rigid than a wire seal 44 located at the rearward end of the housing 40. Seal 44 is of substantially the same construction as seal 16. Note that a large portion of seal 44 extends beyond the rear face of the housing body 41 in the same manner as a large portion of seal 16 extends beyond the rear face of the housing 11. Exposure of the seal in this manner facilitates more rapid cycling times in the molding process since heat transfer from the molten seal material 44 through the metal mold assembly is more rapid.

Figure 2:
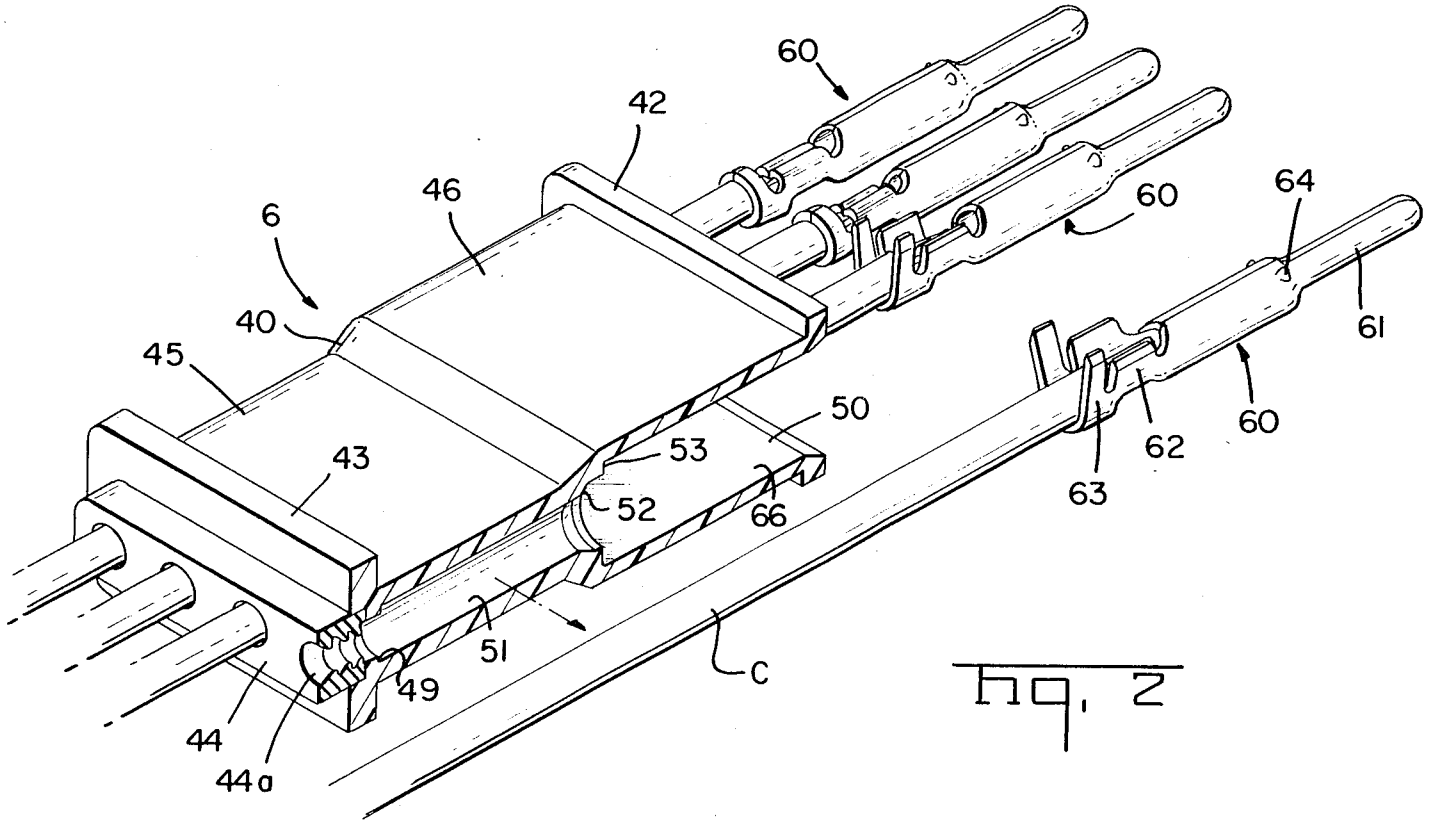
FIG. 2 is a perspective view of a female pin connector showing the manner in which the terminals are crimped to the conductors.

Seal 44 has a plurality of sealing ribs 44a on the inner periphery of holes extending through the seal. These ribs **44*a* are angled inwardly, as shown in FIG. 2, to facilitate insertion of the conductors C through the seal. Seal 16** has similar ribs. When the terminated conductors are pulled in the opposite direction to position terminals within the dielectric housings, the angled rib seals are deformed in the opposite direction to form a tight sealing engagement with the conductors.

Relatively rigid housing body 41 has a front flange and a rear flange which serve the same purposes as the flanges 14 and 15 on the receptacle body. Flanges 42 and 43 extend from the front and rear of the pin housing body 41 respectively. The housing body 41 has a step configuration formed by a smaller section 45 located adjacent the rear end and a larger section 46 located adjacent the forward end of body 41. A transition section 47 is located intermediated these two sections. The housing walls of sections 45 and 46 may be of the same thickness, but the smaller section 41 contains a plurality of generally cylindrical passages 51 extending from the rear face of the housing 41 to communicate with a common cavity 50 located within the larger body section 46. All of the separate passages 51 communicate with the common cavity 50 in the preferred embodiment of this invention.

A generally right angular inner transition shoulder 53 in the general vicinity of the outer transition section 47 merges with a retention relief section 52 as shown in FIG. 2. Retention relief sections 52 are formed in surrounding relationship to each tubular passage 51. Pin terminals 60 are generally conventionally stamped and formed from terminals having a pin section 61 and wire crimp section 62. Insulation crimp 63 is located adjacent the rear of each terminal. Protrusions 64 extend around the periphery of the central portion 65 of each pin terminal 60. These protrusions 64 extend radially beyond the remainder of the stamped and formed pin terminal 60. As with the receptacle terminals in housing 10, the pin terminals 60 are crimped to a wire after the wire is inserted from the rear of the housing with its end extending beyond the front face of the housing body 41. After a plurality of terminals 60 have been crimped to the wires, the wires are again withdrawn into the connector 40. The rear portion of each terminal 60 would engage a constricted shoulder 49 within each passage to prevent damage to seal 40. Bosses 64 can be generally received within the relief portion 52 and would abut relief portion 52 prior to engagement of the terminal with the seals 44. Thus a redundant housing-terminal engagement is provided.

Figure 7:
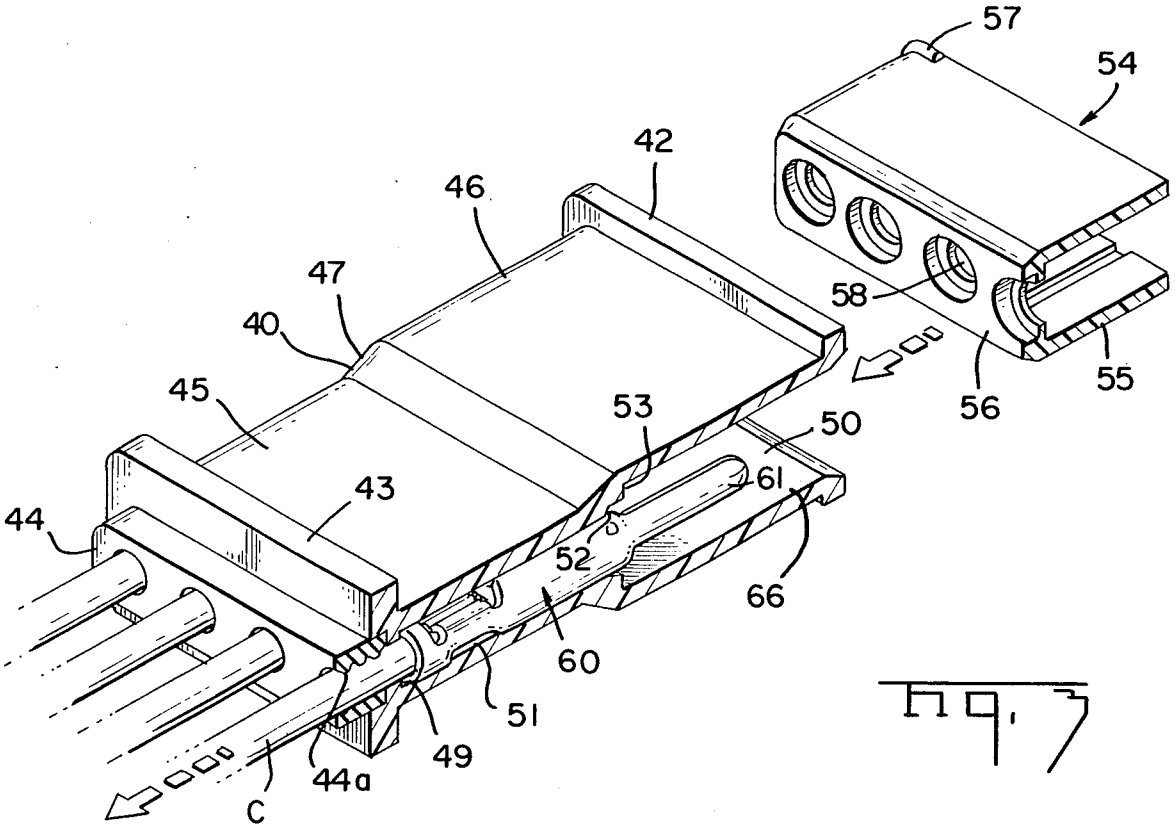

In order to prevent the terminal 61 from being pushed from the front of the housing 40 out of cavity 50, a retention insert 54 generally conformable to the inner contour of the cavity 50 can then be inserted. Retention insert 54 has peripheral sidewalls extending from a common insert base 56. One inner endwall of the insert 54 has a curved surface 71 (FIG. 8) while the other inner endwall has a rectangular surface 72 (FIG. 7). A plurality of holes 58 extend through the insert base 56 and are positioned to be received around the pin terminals 60. The holes 58 have a inner diameter which is less than the outer diameter of the retention bosses 64, thus engaging the terminals 60 to restrain the terminal within the housing 40. Retention ribs 57 extend around at least a portion of the free end of the housing insert 54. These ribs 54 engage the housing in a manner similar to the ribs 34 of the retention cap 30 since the retention insert is also formed of a material less susceptible to plastic flow than the body 40. An interior surface on one end of the retention insert 54, has a curved surface conformable with the curved exterior 38 of the mating housing 10.

As shown in FIG. 5, the retention insert 54, when fully inserted into the cavity 50, leaves a portion of the interior of cavity 50 exposed. This portion 66 will form a sealing surface. Since the peripheral seal 12 located on the receptacle connector 10 is located intermediate the ends of the connector, seal 12 can engage the sealing surface 66 as shown in FIG. 5.

The retention insert 54 and the retention cap 30 not only serve as means to retain the terminals within the housing, but also serve as means to form a modular keying assembly. Retention caps 30 have one or more protruding keys 32 located around the periphery of the cap. Insert 54 has a like number of keyway slots 59 located on the inner surface of the sidewalls 55. The protruding keys 31 and 32 can be received within correspondingly aligned keyway slots 59. The opposite flat and curved surfaces 36 and 38 on housing 10 are only insertable in one orientation into insert 54 due to the matching interior curved and rectangular surfaces 71 and 72. Since the caps and inserts are each separately insertable into the respective housing bodies, a large number of differentially keyed caps and housing inserts can be employed to form a selective interconnection system without requiring the use of different connector halves 10 and 40.

Figure 8:
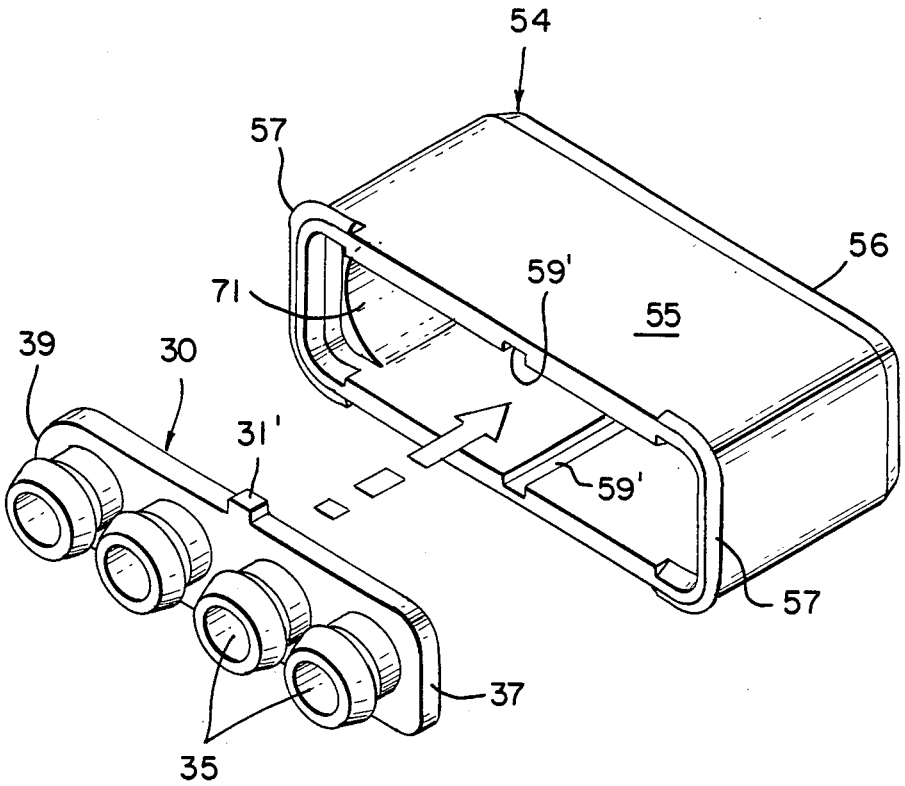
Figure 7:
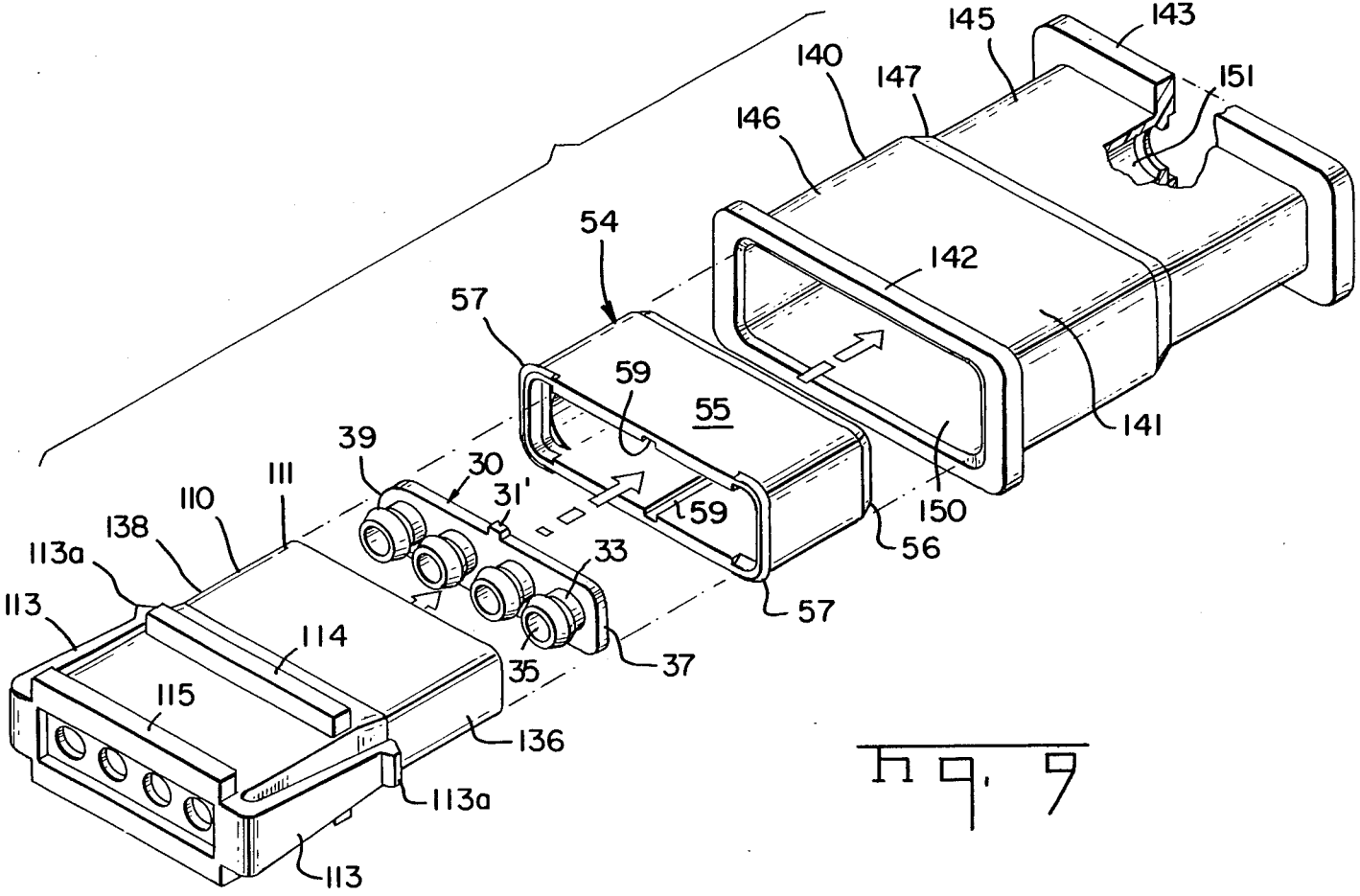

As shown in FIGS. 6, 7 and 8, by merely shifting the location of keys 31 and 32 and keyway slots 59, similar connectors can be either matable or unmatable, thus allowing the use of a plurality of similar connectors but precluding interconnection of connectors which are not intended to be mated.

The retention and keying configuration of insert 54 and cap 30 can also be employed in an unsealed version of a companion connector. The sealed housings 10 and 40 are each formed by a dual molding process in which the more rigid bodies 11 and 41 are initially formed, followed by molding of seals 12, 16 and 44 in the same mold after movement of sleeves or core pins to define new cavities. By eliminating the second step, only more rigid dielectric bodies, such as 111 and 141 as shown in FIG. 9 would be formed. Similar features of the embodiments of FIG. 9 are numbered with corresponding 100-series numerals. Since the cap 30 and insert 54 remain unchanged, the same numerals are used. The retention insert 54 and cap 30 would still function in the same manner. The retention insert 54 provides a tight fit with the mating half of the rigid body 111 thus aligning the connector halves in the unsealed embodiment.

What is claimed:

1. A sealed electrical connector comprising:

a unitary housing further comprising a relatively rigid body and a relatively flexible sealing member integral with the body, the housing having a plurality of separate passages extending through both the sealing member and a portion of the body, each passage communicating with a common cavity, opening on a mating end of the body opposite from the sealing member;

a plurality of terminals, each terminal being located in one passage within the body and extending into the common cavity; and a keying and retention member insertable into the cavity and comprising peripheral sidewalls generally conformable to the cavity, the sidewalls extending from edges of a common base to free ends spaced from the base, the sidewalls having keying means defined thereon and extending from the free ends towards the base, the base having a plurality of holes, the keying and retention member being insertable into the cavity and engaging the body within the cavity, portions of the terminals extending into the cavity being insertable through the holes, the base engaging the terminals adjacent the holes to retain the terminals in the housing, a complementary connector matable with the sealed electrical connector being partially insertable into the cavity and into the keying and retention member, a complementary keying surface on the complementary connector engaging the keying means to orient the two connectors.

2. The connector of claim 1 wherein the keying means comprises a keyway slot communicating with the interior of one of the sidewalls and comprising means for receiving a complementary protruding key comprising the keying surface on the complementary connector upon mating of the two connectors.

3. The connector of claim 1 wherein the terminals have protruding bosses, the common base engaging the bosses to retain the terminals in the housing.

4. The connector of claim 3 wherein the protruding bosses extend outwardly beyond the periphery of the passages.

5. The connector of claim 1 wherein interior walls of the housing define the cavity, the interior walls extending beyond the keying and retention member to form a sealing surface, a peripheral seal on the complementary connector engaging the sealing surface.

6. The connector of claim 1 wherein the sealing member extends outwardly beyond an end of the body.

7. The connector of claim 1 wherein the sealing member has a plurality of sealing passages, each sealing passage being in alignment with a passage in the connector body.

8. The connector of claim 7 wherein the sealing member comprises means for establishing a seal around a plurality of wires.

9. An electrical connector assembly comprising first and second electrical connectors, each connector comprising:

a housing comprising a relatively rigid body, each housing having a plurality of separate passages extending through at least a portion of the body; the first connector housing having a common cavity, each passage in the first connector housing communicating with the common cavity opening on the mating face of the body, the passages in the second connector housing extending throughout the length of the second connector body:

a plurality of terminals, each terminal being located in one passage, the terminals in the first connector extending into the common cavity, the terminals in the second connector being confined to the passages in the second connector body; and modular keying and retention means comprising first and second keying and retention members attachable to the first and second connector bodies respectively, the first keying and retention member being insertable into the cavity and comprising peripheral sidewalls generally conformable to the cavity, the sidewalls exending from edges of a common base to free ends spaced from the base, the sidewalls having a first keying surface defined thereon and extending from the free ends toward the base, the base having a plurality of holes, the first keying and retention member being insertable into the cavity and engaging the rigid body within the cavity, portions of the terminals extending into the cavity being insertable through the holes, the base engaging the terminals to retain the terminals in the housing, a second keying and retention member on the complementary second connector being insertable into the cavity and into the first keying and retention member, a complementary second keying surface on the second keying and retention member engaging the first keying surface to orient the two connectors, separate sets of complementary first and second keying and retention members being attachable to the first and second connectors to permit mating of first and second connectors only with complementary first and second keying members.

10. The electrical connector of claim 9 wherein each housing comprises a unitary element having a relatively rigid body and a relatively flexible sealing member integral with the body, the sealing member having a plurality of holes aligned with the passages, the sealing member being in the end of the housing opposite from the mating face.

11. A sealed electrical connector assembly comprising:

a first connector comprising a unitary housing, a plurality of terminals and a separate retention insert, the unitary housing further comprising a relatively rigid body and a relatively flexible sealing member integral with the body, the housing having a plurality of separate passages extending through both the sealing member and a portion of the body, each passage communicating with a common cavity, opening on a mating end of the body opposite from the sealing member, the common cavity having an interior sealing surface extending completely around the inner periphery of the common cavity, the sealing surface extending from the mating end of the rigid body and terminating intermediate the ends of the rigid body adjacent the passages, each terminal being located in one passage and extending into the common cavity, the separate retention insert insertable into the cavity and comprising peripheral sidewalls generally conformable to the cavity, the sidewalls extending from edges of a common base to free ends spaced from the base, the base having a plurality of holes, the retention insert being insertable into the cavity and engaging the body, the height of the sidewalls being less than the height of the sealing surface so that the ends of the retention insert are spaced from the mating end of the first connector body, portions of the terminals extending into the cavity being insertable through the holes, the base engaging the terminals to retain the terminals in the housing, and a complementary second connector matable wih the first connector, the second connector being partially insertable into the cavity and into the retention insert, the second connector having a flexible peripheral seal integral with a rigid body portion and extending around the outer periphery thereof, the flexible peripheral seal engaging the common cavity sealing surface between the first connector retention insert and the mating end of the first connector upon insertion of the second connector into the first connector.

12. The connector of claim 11 wherein the peripheral seal is spaced from a mating end of the second connector body.

13. The connector of claim 12 further comprising a retention cap attachable to the mating end of the second connector body.

14. The connector of claim 13 wherein the retention cap has a plurality of tubular projections and the second connector body has a plurality of passages, each tubular projection being insertable into a passage.

15. The connector of claim 13 wherein the retention cap and the retention insert each have corresponding keying means thereon for keying engagement of the first and second connectors.

* * * * *